United States Patent [19]

Taylor et al.

[11] Patent Number: 4,744,801

[45] Date of Patent: May 17, 1988

[54] FUEL OIL COMPOSITIONS

[75] Inventors: Malcolm G. Taylor, Marlow Bottom; Henry E. Blackshaw; David J. Claydon, both of Wantage, all of United Kingdom; Stephan Ilnyckyj, Mississauga, Canada

[73] Assignee: Exxon Chemical Patents Inc., Linden, N.J.

[21] Appl. No.: 855,180

[22] Filed: Apr. 23, 1986

[30] Foreign Application Priority Data

Apr. 26, 1985 [GB] United Kingdom ..... 8510721
Dec. 16, 1985 [GB] United Kingdom ..... 8530907

[51] Int. Cl.[4] ..... C10L 1/18; C10L 1/22

[52] U.S. Cl. ..... 44/71; 44/76; 44/77

[58] Field of Search ..... 44/71, 76, 77

[56] References Cited

U.S. PATENT DOCUMENTS 3,235,497 2/1966 Lee ..... 44/71

3,235,503 2/1966 de Vries ..... 44/71

FOREIGN PATENT DOCUMENTS 0113582 7/1984 European Pat. Off. .

*Primary Examiner*—Jacqueline V. Howard

*Attorney, Agent, or Firm*—R. A. Maggio; M. B. Kapustij

[57] ABSTRACT

A fuel oil composition containing a minor proportion by weight of a mixture of 20 to 40 wt % of a polyphenol, a sulphurized polyphenol or a hindered phenol and 80 to 60 wt % of a cyclic amide derived from a dicarboxylic acid or anhydride having a hydrogen-and-carbon containing substituent of at least 40 carbon atoms and a polyalkylene polyamine having at least 2 nitrogen atoms and at least 3 carbon atoms (other than carbon atoms in the branched substituents) between the terminal amino groups.

A suitable additive is a 70% by weight of the macrocyclic derivative of polyisobutenyl succinic anhydride (MW 1300) and penta propylene hexamine and 30% by weight of 4,4[1] methylene bis (2,6 di tert butyl phenol).

12 Claims, No Drawings

FUEL OIL COMPOSITIONS

This invention concerns fuel oils especially middle distillate fuel oils having improved storage stability and diesel fuel having a reduced tendency to form deposits in diesel engine injector nozzles.

The increased tendency to upgrade low value crude residue to higher value products is having a considerable effect on the distillate quality. The ratio of aromatic unstable conversion streams to straight run streams is increasing and this results in refineries having increased difficulty in ensuring the long term storage stabilities of middle distillate fuels. The main difficulties occur when blending high volumes of thermally cracked gas oil with the distillate pool. These streams are particularly high in pyrollic nitrogen and thiophene compounds which initiate the radical polymerisation reactions which give rise to gum and sediment.

This problem has been at least partially solved in different ways.

First, the refinery can restrict the volume of conversion streams blended to distillate. This however leads to a downgrading of the fuel and negates the incentive to run the conversion plant.

Second, the refiner can hydrofine the streams to remove the nitrogen and sulphur precursors. Although this is the most common solution, this incurs hydrofiner operating costs and with major stability problems is often not sufficient to avoid sediment formation.

The third, is the use of an additive and various ones have been proposed and used with varying degrees of success.

In addition as the quality of the distillate reduces the tendency of the fuel to form deposits in the fuel injector nozzles in diesel engines increases leading to inefficient combustion of the fuel reducing power output and increasing noise and toxicity levels and fuel consumption increases. It has been proposed in our European Patent publication No. 0113582 that certain macrocyclic polyamine and polycyclic polyamine compounds may be used as dispersants in lubricants optionally together with phenols. It is also proposed that the dispersants themselves may be used in diesel fuels or fuel oils.

We have now found that a particular additive combination when added to a fuel oil has been found to be particularly effective in reducing sediment and gum formation during storage and also reduces the coking of fuel injector nozzles when the fuel is used as a diesel fuel.

According to this invention a fuel oil composition comprises a fuel oil and a minor proportion by weight of a mixture of 20 to 40 wt% of a polyphenol, sulphurised polyphenol or a hindered phenol (as hereinafter defined) and 80 to 60 wt% of a cyclic amide derived from a dicarboxylic acid or anhydride having a hydrogen and carbon containing substituent of at least 40 carbon atoms and a polyalkylene polyamine having at least 2 nitrogen atoms preferably at least 3, and at least 3 preferably at least 4 carbon atoms (other than carbon atoms in the branched substituents between the terminal amino groups).

The polyphenols or sulphurised polyphenols are defined as compounds or polymers containing at least two hydrocarbyl substituted phenols linked together via bridges formed by one or more sulphur atoms or by an alkylene group. They are typified by structures such as:

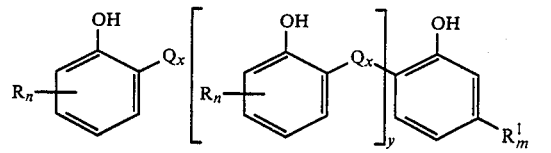

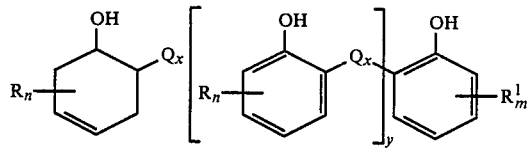

and

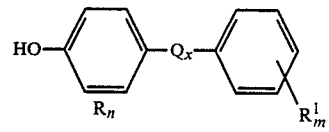

where R and $R^1$ are hydrocarbyl groups, Q is sulphur or an alkylene group, preferably methylene, m and n are zero or integers of 1 to 4 provided m and n are not both zero, y is zero or an integer and x is an integer.

Usually the hydrocarbyl groups contain from 5 to 60 carbon atoms and although they can be alkenyl, aryl, aralkyl or alkaryl for example, it is preferred that they are alkyl and especially ones containing 8 to 20 carbon atoms, e.g. nonyl, decyl, dodecyl or tetradecyl. Non alkyl substituents which could be used include dedecenyl, phenylethyl and benzyl.

It is preferred that each benzene ring be substituted with just one hydrocarbyl group, usually in the para position, but if desired n and or m could be for example 2 or 3. X and y are preferably integers of 1 to 4.

When a sulphurised polyphenol is used it is preferred that it contains from 2 to 14% by weight, preferably 4 to 12% by weight of sulphur based on the total weight of sulphurised polyphenol.

Specific examples of such sulphurised polyphenols are 2,2'-dihydroxy-5,5' dimethyl diphenyl sulphide; 55'-dihydroxy-22'-di-t-butyldiphenyldisulphide; 44'-dihydroxy-33'-di-t-butyldiphenylsulphide; 22'-dihydroxy-55'-dinonyldiphenyldisulphide; 22'-dihydroxy-55'-dinonyldiphenylsulphide; 22'-dihydroxy-55'-didodecyldiphenylsulphide; 22'-dihydroxy-55'-didodecyldiphenyldisulphide; 22' dihydroxy-55' didodecyldiphenyltrisulphide; and 22'-dihydroxy-55' didodecyldiphenyltetrasulphide. Examples of the polyphenols are $2,2^1$-dihydroxy-$5,5^1$-dimethyl diphenyl methane; $22^1$-dihydroxy-$5,5^1$-dinonyl diphenyl methane and $4,4^1$-dihydroxy-$3,3^1$-di-t-butyl diphenyl methane.

As an alternative to or if desired in addition to the polyphenol or sulphurised polyphenol one can use a hindered phenol, by which term we mean a phenol having in one or two ortho positions a bulky substituent, this being preferably an aromatic group, a cycloalkyl group, or a secondary or tertiary alkyl group. These hindered phenols may have the formula:

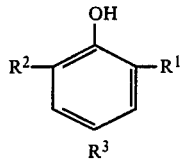

where $R^1$ is aromatic, cyclo alkyl or alkyl preferably secondary or tertiary alkyl and $R^2$ and $R^3$ are hydrogen or aromatic cycloalkyl or alkyl, preferably secondary or tertiary alkyl. Thus, the hindered phenol may have three substituents.

It is preferred that there are two ortho position substituents, i.e. that $R^2$ is not hydrogen. Although $R^1$, $R^2$ and $R^3$ can be aromatic, e.g. phenyl, it is preferred that they are cyclo alkyl, secondary or tertiary alkyl, tertiary alkyl being especially preferred. The secondary alkyl groups will have a minimum of three carbon atoms and preferably from 4 to 10 carbon atoms, sec butyl, sec phenyl and sec-octyl being particularly preferred. The tertiary alkyl groups will have a minimum of 4 carbon atoms and preferably 4 to 10 carbon atoms, tert-butyl, tert-hexyl, tert-decyl being particularly suitable.

Particularly suitable hindered phenols are 2,4,6 tritert butyl phenol, 2,6-disecbutyl phenol and 2,6 dicyclo pentyl phenol. Less suitable hindered phenols include 2-methyl-6-tert butyl phenol and 2-methyl-6-tertoctyl phenol.

Other suitable hindered phenols are compounds which include an alkylene bridge, for example a methylene bridge and include compounds such as:

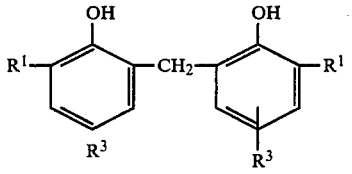

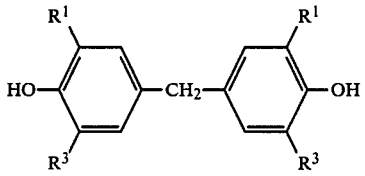

and

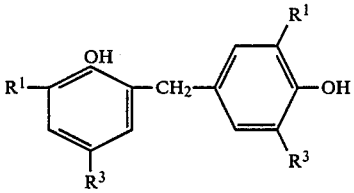

where $R^1$ and $R^3$ are the same as defined above in connection with the other hindered phenols. These may be considered as particular examples of the polyphenols already disclosed.

Useful cyclic amides are described in European Patent Application No. 83307871 and may be derived from a dicarboxylic acid or anhydride having a hydrogen and carbon-containing substituent of at least 40 carbon atoms. This may be conveniently represented as:

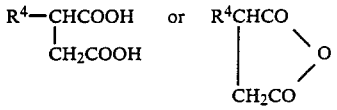

where $R^4$ contains at least 40 carbon atoms. The polyalkylene polyamide from which it is also derived may be represented by the formula $H_2N\ (alkNH)_n alk\ NH_2$ where n is zero or an integer and alk represents an alkylene group provided the total number of nitrogen atoms plus carbon atoms (other than carbon atoms in branched substituents) between the terminal amino groups is at least 3, preferably at least 5 and more preferably at least 7. The cyclic amide may therefore be represented as:

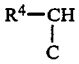

Where the total number of ring carbon atoms and ring nitrogen atoms in the ring containing the alkylene units is at least six and preferably at least eight and more preferably at least ten. The substituent of the acid or anhydride from which the cyclic amide is derived preferably only contains hydrogen and carbon atoms, i.e. it is hydrocarbyl, although if desired it could for example contain other atoms e.g. halogen atoms, or groups. The preferred hydrocarbyl group is an aliphatic group, e.g. alkyl or alkenyl. Particularly preferred are alkenyl groups derived from the polymerisation of a mono olefin, e.g. a $C_2$ to $C_5$ mono olefin, such as ethylene, propylene or isobutene. These polymers will usually only have one double bond.

Although the most preferred acids or anhydrides from which the cyclic amides is derived are those of the formula:

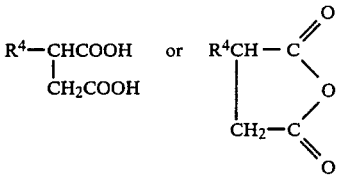

and especially where $R^4$ is polyalkenyl, e.g. polyisobutenyl, and has 40 to 200 carbon atoms, e.g. 50 to 100 and especially, about 84 carbon atoms, it should be understood that the cyclic amide could be derived from other types of dicarboxylic acid or anhydride for example those of the formulae:

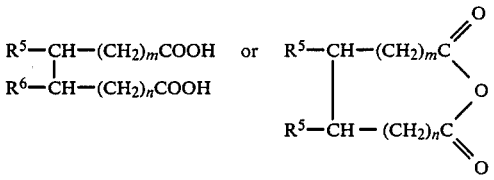

where $R^5$ and $R^6$ are hydrogen or hydrogen- and carbon-containing group of at least 40 carbon atoms provided they are both not hydrogen and m and n being zero or integers, especially small integers, e.g. 1 or 2.

The polyalkylene polyamine may in general be represented as:

$$HR^7N(alkNR^8)_nalkNHR^7$$

where $R^7$ and $R^8$ are hydrocarbyl, (e.g. alkyl) or preferably hydrogen, alk is alkylene and n is zero or an integer provided the total number of nitrogen atoms plus carbon atoms (other than branched substituents) between the terminal amino groups is at least three preferably at least five and more preferably at least seven. When $R^7$ and $R^8$ are hydrocarbyl they are preferably alkyl and preferably contain 1 to 10 carbon atoms, for example they are methyl, ethyl or propyl. The alkylene group represented by alk can be methylene or polymethylene, e.g. ethylene. The alkylene group can however be branched e.g. sec propylene or iso butylene. The integer n is preferably 2, 3 or 4 which means that the cyclic amide contains in such cases 4, 5 or 6 nitrogen atoms in the ring.

Examples of suitable polyalkylene polyamines are triethylene tetramine, tetra ethylene pentamine, pentaethylene hexamine, tri propylene tetramine, tetrapropylene pentamine, tetrabutylene pentamine and octa ethylene pentamine. The most preferred polyalkylene pentamine is penta propylene hexamine and the most preferred cyclic amide is:

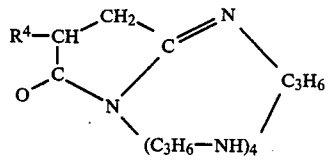

where $R^4$ is polyisobutylene having a molecular weight of about 1200.

These macrocyclic derivatives are usually made by a cyclodehydration reaction, e.g. heating to 110° C. to 250° C., following the reaction of the acid or anhydride with the polyamine in which reaction the acid or anhydride is slowly added to the polyamine at a relatively low temperature e.g. 20° to 100° C.

The mixture of polyphenol, sulphurised polyphenol or hindered phenol and cyclic amide preferably comprises 25 to 35 wt%, e.g. about 30 wt% of the polyphenol, sulphurised polyphenol or hindered phenol and 65 to 75 wt%, e.g. about 70 wt% of the cyclic amide.

The additive i.e. the mixture of cyclic amide and polyphenol, sulphurised polyphenol or hindered phenol, may be added to any fuel oil, but it is particularly useful in reducing sediment formation in cracked gas oils and especially catalytically cracked heavy gas oils which contain visbroken gas oil components. The fuel oils which are particularly suitable are the distillate fuel oils e.g. those boiling in the range of 150° C. to 400° C., particularly those having a relatively high final boiling point (FBP) of above 360° C. Typical blends of fuel oil which have gum and sediment portions reduced by the additive of this invention comprise 40 to 85 wt% of a light distillate oil, 0 to 14 wt% of a heavy distillate oil, 0 to 25 wt% of kerosene and 1 to 30 wt% of visbroken gas oil, for example 85 wt% light distillate oil and 15 wt.% of visbroken gas oil.

When the additive combination is added to diesel fuel we find that its presence significantly reduces the coking of engine injectors ensuring that fuel flow and fuel spray into the combustion chamber is maintained thus maintaining power output and reducing noise and toxicity levels. In addition we have found that the presence of the additive decreases fuel consumption.

The amount of the additive combination which is added to the fuel oil is a minor proportion by weight preferably up to 20 wt.%, e.g. up to 10 wt.% and most preferably 0.00001 to 1 wt.%, especially 0.00001 to 0.00002 wt%. It should be understood that these proportions apply to the actual amount of additive and not to the total weight of oil concentrate which is the preferred way of storing and handling the additive. The additive may also be added in combination with other typical fuel additives such as low temperature flow improvers, cetane improvers, antioxidants and the like.

The additive i.e. the mixture of cyclic amide and polyphenol, sulphurised polyphenol or hindered phenol, may be conveniently dissolved in a suitable solvent to form a concentrate of from 20 to 90, e.g. 30 to 80 weight % of additive in the solvent. Suitable solvents include kerosene aromatic naphthas, mineral lubricating oils etc. Such concentrates are also within the scope of the present invention and may also contain other additives.

EXAMPLE 1

Additives of this invention and for comparison purposes other additives, were added to a fuel blend consisting of 54 wt% light distillate oil (desulphurised)
20 wt% kerosene
11 wt% heavy distillate oil and
15 wt% visbroken gas oil The cyclic amide forming part of the additive of the invention was the macrocyclic derivative of polyisobutenyl succinic anhydride (MW 1300) and penta propylene hexamine (component A). This was combined separately with two different hindered phenols—one (component B) was 4,4[1] methylene bis(2,6 di tert butyl phenol) and the other (component C) was 2,4,6-tri t-butyl phenol. In each case there was 70 wt% of A and 30 wt% of either B or C.

Additive D (prior art) was a metal deactivator tuned for impurities for copper metal.

In each case the additive, i.e. either A, B, C or D separately or 70/30 combinations of A with B, C or D, was added at a concentration of 100 ppm to the fuel blend.

The results obtained were as follows:

| | Weight of Sediment (mgm/700 ml) | | Colour | |
|---|---|---|---|---|
| Additive | Before Ageing | After Ageing | Before | After |
| None | 0.8 | — | L3.0 | — |
| C | | 4.7 | | L4.0 |
| B | | 3.2 | | 3.5 |
| D | | 6.1 | | 4.0 |
| 70/30 A/C | | 0.4 | | L4.0 |
| 70/30 A/B | | 0.6 | | L4.0 |
| 70/30 A/D | | 0.8 | | 4.0 |

This sediment was determined in this and other Examples by the AMS 77.061 as the method of test. In this test a 700 $cm^3$ portion of the sample as received is presaturated with air and artificially oxidised under carefully prescribed conditions. After cooling, the oil is filtered and the amount of sediment noted. An equal portion of the sample as received is also filtered, the amount of sediment noted, and the net sediment due to oxidation calculated. Additional tests such as colour are also made on both the oxidised and the unoxidised portions. The net sediment due to oxidation and the differences in the other tests are all measures of the stability of the product.

It is clear that the combinations of A with B or C are most effective in controlling the sediment and it is clear that during the accelerated stability test they actually reduce the original sediment. Although the colour still degrades upon ageing it is not worsened by the additives of this invention.

EXAMPLE 2

Example 1 was repeated using the same fuel blend, the same component A, the same component C and a different hindered phenol and certain sulphurised phenols. The hindered phenol (component E) was 2,6 di tert butyl-dimethylamino-p-cresol and the sulphurised phenols (components F & G) were nonyl phenol sulphides.

Component A was mixed separately with components C, E, F & G in a 70:30 weight ratio. In all but one case 100 ppm (parts by weight per million by weight) of additive was added based either on the total weight of fuel blend or on the weight of the visbroken gas oil component. In the last case 50 ppm of additive based on the visbroken gas oil component was used.

The results obtained were as follows:

| | Weight of Sediment (mgm/700 ml) | | Colour | |
|---|---|---|---|---|
| Additive | Before Ageing | After Ageing | Before | After |
| None | 1.6 | 3.5 | L3.0 | L4.5 |
| A/C (100 ppm blend) | | 1.1 | | L4.0 |
| A/C (100 ppm VBGO) | | 1.1 | | L4.0 |
| F (100 ppm VBGO) | | 1.7 | | L4.0 |
| G (100 ppm VBGO) | | 3.5 | | L4.0 |
| A/F (100 ppm VBGO) | | 0.8 | | L4.0 |
| A/G (100 ppm VBGO) | | 0.9 | | L4.0 |
| A/E (100 ppm VBGO) | | 1.0 | | L4.0 |
| A/C (50 ppm on VBGO) | | 3.3 | | L4.0 |

It is clear that apart from the last result combinations of A with C, E, F or G are very effective in not only preventing sediment formation but in reducing the original sediment. From the last result it appears that when using a sulphurised phenate 50 ppm based on the visbroken gas oil component is not sufficient.

EXAMPLE 3

A different fuel oil was used, this being a fluid catalytic cracked gas oil.

To this fuel was added at 100 ppm a 70:30 weight blend of component A and component F (See Examples 1 & 2). Once again sediment formation was not only prevented but the original sediment was reduced.

| | Weight of Sediment (mgm/700 ml) | | Colour | |
|---|---|---|---|---|
| Additive | Before Ageing | After Ageing | Before | After |
| None | 0.5 | 0.6 | L1.5 | L3.0 |
| A/F 100 ppm | | 0.4 | | 2.0 |

EXAMPLE 4

The effectiveness of the additives on the coking of injector nozzles in diesel engines as determined using a Fiat Ritmo engine having the following specification.

| | |
|---|---|
| NUMBER OF CYLINDERS | 4 in line |
| SPEED | 4500 rpm |
| MAXIMUM POWER | 42.66 Kw |
| BORE | 83 mm |
| STROKE | 79.2 mm |
| DISPLACEMENT | 1.714 liters |
| COMPRESSION RATIO | 20.5:1 |
| OIL VOLUME | 5.0 liters |

In the tests the engine is run for 60 twenty minute cycles to simulate the urban driving cycle. Each cycle consists of four 5 minute periods as follows:

| | | | | |
|---|---|---|---|---|
| (a) | 1000 rpm | idle | 0 BHP | 0 LOAD |
| (b) | 3000 rpm | 65% potential speed | 27 BHP | 40–45% MAX LOAD |
| (c) | 1600 rpm | 35% potential speed | 7.2 BHP | 35–40% MAX LOAD |
| (d) | 4200 rpm | 90% potential speed | 42 BHP | 70–80% MAX LOAD |

Before and after the engine test the injectors are rated according to the 'Ricardo air-flow test method'. This test works on the principle of a vacuum being maintained across the injector at different needle lifts. In order to maintain this vacuum at the desired level the air-flow into the injector may vary. The air-flow into the injector is recorded and becomes less as the injectors become coked. The results are recorded as the difference between clean and dirty i.e. before and after test air flow. The formula used is as follows:

PERCENT AIR FLOW LOSS =

$$\frac{\text{BEFORE TEST} - \text{AFTER TEST \%}}{\text{BEFORE TEST}}$$

The Additives used in the tests were

| | | |
|---|---|---|
| ADDITIVE G | | |
| | 32% | ADDITIVE H |
| | 11% | ADDITIVE I |
| | 57% | ADDITIVE E |
| ADDITIVE H | 50 wt. % oil solution of a condensation product of PIBSA 112 intermediate and polyamine in a 2.8:1 molar ratio | |
| ADDITIVE I | Either p-nonyl phenol trioxyethanol or iso-octyl phenoxy tetraethoxyethanol | |
| ADDITIVE J | 43 wt. % Amino nonyl phenol formaldehyde resin in Stanco 150 neutral oil | |

and were incorporated in the following diesel fuel

| | |
|---|---|
| DENSITY 150 | 0.8504 |

-continued

| | |
|---|---|
| KV 20C | 6.52 |
| KV100C AUTO | 1.475 |
| R BTM CARB | 0.04 |
| CON CARB | NIL |
| BROMINE NO | 2.89 |
| F.I.A. AROMATICS | 30.0 |
| OLEFINS | 4.5 |
| SATURATES | 65.5 |
| CETANE NO: | 49.0 |
| SULPHUR WT. % | 0.5 |

and the test results are set out in the Attached Table I and are depicted graphically in FIG. 1 showing the significant reduction in air loss when using the additives of the invention.

TABLE I

| NEEDLE LIFT | NO ADDITIVE | FUEL + 140 ppm ADDITIVE A | FUEL + 45 ppm ADDITIVE B | FUEL + 140 ppm ADDITIVE B 80 ppm MIXTURE OF ADDITIVE A & F |
|---|---|---|---|---|
| 0.01 | 45.47 | 43.67 | 36.85 | 56.27 |
| 0.02 | 67.82 | 58.65 | 50.46 | 26.54 |
| 0.05 | 79.41 | 68.82 | 58.80 | 49.89 |
| 0.10 | 80.65 | 67.61 | 59.42 | 47.25 |
| 0.15 | 78.02 | 65.42 | 58.28 | 43.51 |
| 0.20 | 75.22 | 61.38 | 55.57 | 42.23 |
| 0.25 | 71.57 | 54.29 | 52.78 | 38.61 |
| 0.30 | 65.11 | 44.33 | 45.63 | 36.59 |
| 0.35 | 55.36 | 37.52 | 37.73 | 32.68 |
| 0.40 | 42.46 | 28.69 | 25.87 | 28.97 |
| 0.45 | 33.06 | 20.01 | 20.84 | 24.61 |
| 0.50 | 21.14 | 15.64 | 15.09 | 18.63 |
| 0.55 | 16.97 | 18.93 | 13.48 | 23.59 |
| 0.60 | 16.65 | 13.75 | 9.75 | 24.10 |
| 0.65 | 8.39 | 11.32 | 5.84 | 13.93 |
| 0.70 | 8.02 | 9.65 | 3.86 | |
| 0.75 | 5.22 | 7.14 | 3.38 | 10.73 |
| 0.80 | 2.54 | 4.58 | 2.29 | 1.18 |

The degree of injector nozzle fouling can also be determined by dismantling the engine and injecting the nozzles and this also demonstrates a significant improvement using the additives of the invention. More complete combination over a running cycle has also been observed with fuels of the invention.

We claim:

1. A fuel oil composition comprising a fuel oil and a minor amount by weight of a mixture of (i) 20 to 40 wt% of polyphenol, sulphurized polyphenol, or mixture thereof, and (ii) 80 to 60 wt% of a cyclic amide derived from (a) dicarboxylic acid or anhydride having a hydrogen-and-carbon containing substituent of at least 40 carbon atoms, and (b) polyalkylene polyamine containing at least 2 nitrogen atoms and at least 3 carbon atoms wherein 2 of said nitrogen atoms are present as terminal amino groups and at least 3 of said carbon atoms are present in a bridging moiety comprising a chain containing at least 3 carbon atoms joining said two terminal amino groups.

2. A composition according to claim 1 wherein the polyalkylene polyamine contains at least 3 nitrogen atoms and said bridging moiety contains at least 4 carbon atoms.

3. A composition according to claim 1 wherein each benzene ring of the polyphenol or sulphurized polyphenol contains one hydrocarbyl substituent group on one ring carbon atom.

4. A composition according to claim 3 wherein said hydrocarbyl substituent group is in the para position.

5. A composition according to claim 1 wherein the cyclic amide is derived from an alkenyl substituted dicarboxylic acid or anhydride.

6. A composition according to claim 5 wherein the alkenyl substituent is polyisobutenyl.

7. A composition according to claim 1 wherein the cyclic amide is derived from pentapropylene hexamine and polyisobutenyl succinic anhydride, wherein the MW of the polyisobutenyl group is about 1200.

8. A composition according to claim 1 wherein the amount of polyphenol, sulphurized polyphenol, or mixture thereof is 25 to 35 wt % and the amount of cyclic amide is 65 to 75 wt %.

9. A composition according to claim 1 comprising 0.00001 to 1 wt % of said mixture of (i) and (ii).

10. A composition according to claim 1 wherein the fuel oil is a cracked gas oil.

11. A composition according to claim 1 wherein the fuel oil is a diesel fuel.

12. An additive concentrate comprising a solution containing 20 to 90 weight percent of a mixture of (i) 20 to 40 wt % of polyphenol, sulphurized polyphenol, or mixture thereof, and (ii) 80 to 60 wt % of a cyclic amide derived from (a) dicarboxylic acid or anhydride having a hydrogen-and-carbon containing substituent of at least 40 carbon atoms and (b) polyalkylene polyamine containing at least 2 nitrogen atoms and at least 3 carbon atoms wherein 2 of said nitrogen atoms are present as terminal amino groups and at least 3 of said carbon atoms are present in a bridging moiety comprising a chain containing at least 3 carbon atoms joining said two terminal amino groups.

* * * * *